United States Patent [19]

Kearns

[11] 3,983,821

[45] Oct. 5, 1976

[54] MECHANIC'S TRAY ASSEMBLY

[76] Inventor: Kenneth R. Kearns, 800 N. Chestnut St., Aberdeen, N.C. 28315

[22] Filed: Oct. 11, 1974

[21] Appl. No.: 514,116

[52] U.S. Cl. ..... 108/42

[51] Int. Cl.[2] ..... A47B 23/00

[58] Field of Search ..... 248/283, 282, 240, 419, 248/122, 121, 224; 108/42, 44, 152, 137, 140; 254/93 L

[56] References Cited

UNITED STATES PATENTS

| | | | |
|---|---|---|---|
| 1,290,072 | 1/1919 | Bullock | 108/27 |
| 1,318,703 | 10/1919 | Stuchlak | 248/282 X |
| 1,528,545 | 4/1925 | Hidi | 108/140 |
| 1,894,991 | 1/1933 | Hayes | 108/140 X |
| 2,510,436 | 6/1950 | Trammell | 108/137 X |
| 2,689,022 | 9/1954 | Neilson | 108/42 X |
| 2,740,678 | 4/1956 | Campbell | 108/140 |
| 3,157,379 | 11/1964 | Platakis | 108/42 |
| 3,279,620 | 10/1966 | Nesbitt | 248/224 X |
| 3,517,625 | 6/1970 | Swett | 108/144 |

*Primary Examiner*—James T. McCall
*Attorney, Agent, or Firm*—Mills and Coats

[57] ABSTRACT

The present invention relates to a mechanic's tray assembly of the type useful in conjunction with a vehicle service rack. The mechanic's tray assembly includes a first swing arm pivotably mounted about a stationary point and extending therefrom, the first swing arm including a collar fixed to the outer end and adapted to pivotably receive a second swing arm therein. The second swing arm, which is pivotable independently of the first swing arm, extends outwardly from the collar secured to the outer end of the first swing arm and includes a generally flat mechanic's tray fixed to the outer end thereof which is adapted to receive and contain various paraphernalia used by a mechanic or serviceman while working on a vehicle.

The mechanic's tray assembly of the present invention is particularly adapted to be used in conjunction with a conventional hydraulic vehicle service rack customarily found in garages and service stations. In such use, the vehicle service rack is preferably provided with two main pivot assemblies, one on each side of the rack. Each pivot assembly is adapted to receive a turned pivot end associated with the first swing arm. In use, the pivot end of first swing arm may be inserted into either main pivot assemblies mounted on the vehicle service rack. Because of the generally central location of each main pivot assembly, the first swing arm of the mechanic's tray assembly may be directed towards various directions and the final position of the tray can be adjusted by pivoting the second swing arm independently of the first swing arm.

2 Claims, 6 Drawing Figures

MECHANIC'S TRAY ASSEMBLY

The present invention relates to trays and receptacles and more particularly to a multi-pivot support assembly for a tray or receptacle to be used in conjunction with a vehicle service rack.

BACKGROUND OF THE INVENTION

In service stations and garages, it is quite common to find a vehicle service rack of the type that normally rests adjacent the floor and is adapted to receive an automobile or motor vehicle thereon, and which is further provided with means to elevate the vehicle a predetermined distance above the floor level where a mechanic or serviceman may gain easy and convenient access to those parts and components of the vehicle disposed about the bottom and lower portions thereof. Typically, such vehicle service racks are used to service the vehicle including changing the oil and lubricating various components of the vehicle, and repairing such components as the exhaust system, the brakes, and generally inspecting the underside of the vehicle. In doing repair or maintenance work, the mechanic or serviceman is usually removing parts or hardware from the vehicle, replacing worn or broken parts with new parts or components and usually such parts removed from the vehicle are done by the use of wrenches and tools.

It is quite common in garages and service stations to find such parts, old and new, and wrenches scattered all over the garage or service station. In such an unorganized working environment, the serviceman or mechanic spends a significant amount of time simply walking back and forth between the vehicle and various places in the garage or service station establishments finding and locating parts and tools. In addition, many jobs require a multiplicity of wrenches and other tools, and the serviceman or mechanic spends a good deal of time keeping up with them while the job is being performed.

SUMMARY OF THE INVENTION

The present invention discloses a mechanic's tray assembly adapted to be used in conjunction with a vehicle service rack or the like for holding parts, hardware such as bolts, nuts, pins, etc., wrenches and other paraphernalia used by the mechanic or serviceman while working on a vehicle. The mechanic's tray assembly of the present invention includes a first swing arm pivotably mounted about a stationary axis relative to the vehicle's service rack or the like, the first swing arm extending from this pivot axis where the outer remote end thereof has a second swing arm pivotably mounted thereto. The second swing arm extends from the pivot point on the first swing arm outwardly therefrom to where a tray is secured on the outer remote end thereof.

When utilized in conjunction with vehicle service racks, the first swing arm is preferably mounted on one side of the rack structure about a central point therefrom. It is, thusly, appreciated that the mechanic's tray can be positioned in an infinite number of positions below the rack and consequently, the mechanic or serviceman may have easy and convenient access thereto irrespective of the particular area of the vehicle in which he is working. Of particular significance, is the fact that the position of the mechanic's tray can be controlled by moving either of the swing arms or both.

For example, if an extreme forward or rearward position is desired, the two swing arms could be adjusted so as to extend in the particular direction desired in alignment or in near alignment. If an intermediate position is desired, i.e., a position between forward and rearward extreme positions, such can be reached by simply moving the second swing arm in a direction to achieve the desired stationing of the mechanic's tray.

It is, therefore, an object of the present invention to provide a mechanic's work tray adapted to be utilized in a vehicle working or repairing environment to hold parts, hardware, wrenches or other paraphernalia used in such working operations by servicemen and mechanics.

A further object of the present invention resides in the provision of a mechanic's tray that is conveniently and readily positionable at an infinite number of positions below a vehicle's service rack when such rack is raised to an elevated position.

Still a further object of the present invention is to provide a mechanic's tray assembly having a series of swing arms pivotably connected in series such that the mechanic's tray may swing about an arcuate path defined by the radius of the combined length of the swing arms, but yet because the swing arms are pivotably connected together the same mechanic's tray can be positioned at any number of positions inwardly of the same defined arc, thereby enabling the tray to be placed at various working positions along one side of the rack occupied by the serviceman or mechanic.

Another object of the present invention is to provide a mechanic's tray assembly having a cantilever swing arm assembly for supporting a mechanic's tray on the outer remote end thereof in which the structure of the cantilever swing arm assembly comprises a series of swing arms pivotably interconnected and adapted to be readily detachable such that the entire swing arm assembly may be removed from one main or central pivot point and installed at another such pivot point.

A further object of the present invention is to provide a mechanic's tray assembly that is relatively simple to construct and use, and is relatively inexpensive to manufacture.

A further object of the present invention is to provide a mechanic's tray assembly and extension support structure therefor wherein the extension structure comprises a series of pivotably connected swing arms that are specifically designed to avoid frictional sliding at the pivot points between the respective swing arms.

Other objects and advantages of the present invention will become apparent from a study of the following description and the accompanying drawings which are merely illustrative of the present invention.

DESCRIPTION OF THE PREFERRED EMBODIMENT

Figure 1:
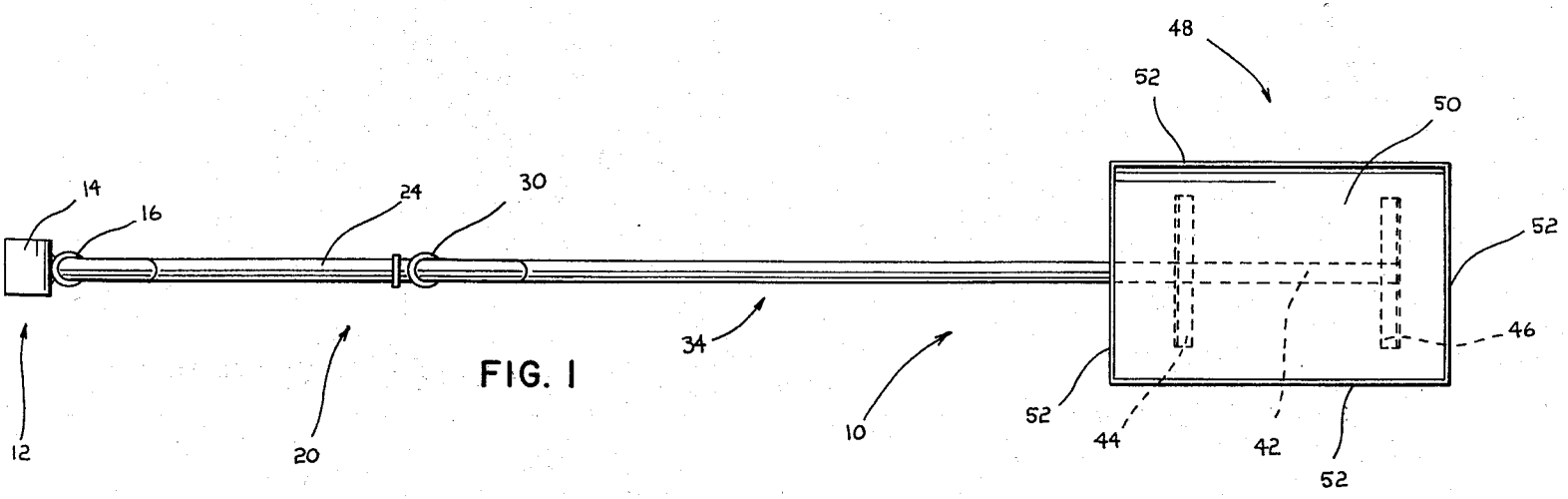
FIG. 1 is a top plan view of the mechanic's tray assembly of the present invention.
Figure 2:
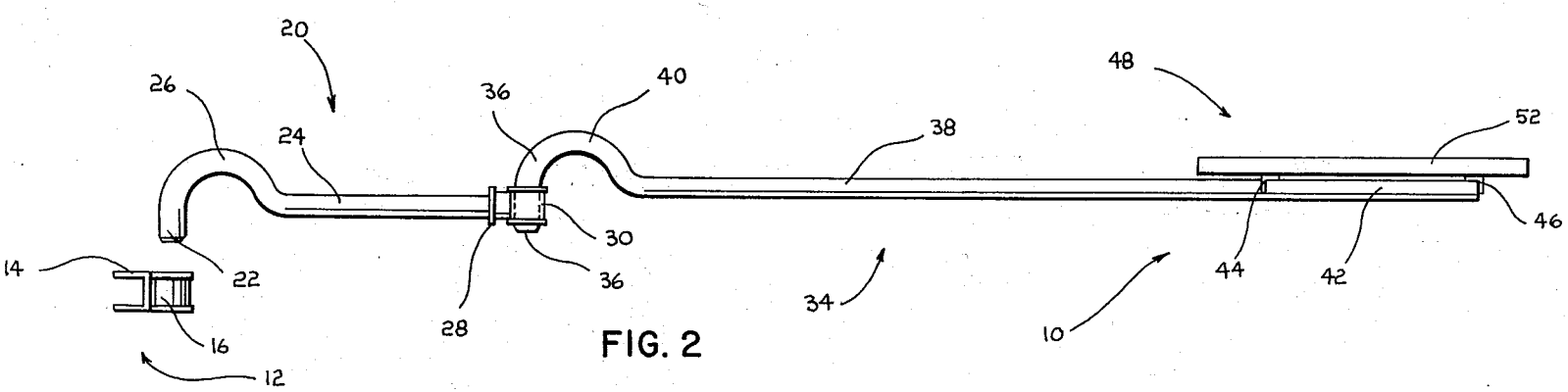
FIG. 2 is a side elevational view illustrating the mechanic's tray assembly of FIG. 1.

With further reference to the drawings, particularly FIGS. 1 and 2, the mechanic's tray assembly of the present invention is shown therein and indicated generally by the numeral 10. Viewing the mechanic's tray assembly in detail, it is seen that the same comprises a central or main pivot structure 12, indicated generally at 12 (FIG. 6), having a bracket 14 and a collar fixed thereto and including a vertical opening 18 formed therein.

Pivotably mounted to said central or main pivot structure 12 is an elongated beam or frame structure including two swing arms, referred to as a first swing arm 20 and a second swing arm 34, pivotably connected together about their inner ends and supporting a mechanic's tray 48 about the outer remote end of the second swing arm 34.

First swing arm 20 comprises an integrally constructed pivot end 22 of a diameter slightly less than the opening 18 formed within the collar 16 of the central or main pivot structure 12. Extending outwardly from the pivot end 26 is a raised arcuate shaped neck 26 that is curved up from the pivot end 22, as viewed in FIG. 2, and curves back downwardly to where this neck portion is integrally constructed with an elongated main portion 24. It is seen that the axis of the pivot end 22 extends generally perpendicular to the axis of the elongated main portion 24, while the raised arcuate shaped neck 26 extends generally between these two portions.

Fixed to the outer end of the elongated main body portion 24 is an intermediate pivot means comprising a coupler 28 having a collar 30 fixed thereto and including a vertical opening 32 therein.

Second swing arm 34 is detachably and pivotably connected to the collar 30 by a pivot end 36 which is integrally constructed therewith. As in the case with the first swing arm 20, the second swing arm 34 also includes an integrally constructed arcuate shaped neck 40 that extends from the pivot end 36. It will be appreciated that the raised neck portions 26 and 40 of both swing arms 20 and 34 tend to assure that the swing arms do not frictionally interfere with the collars 16 and 30 when the arms are pivoted about their respective pivot points. In addition, integrally constructed with the neck 40 is an elongated main portion 38 that includes an outer end portion 42. Similar to the first swing arm 20, the axis of the pivot end 36 extends generally perpendicular to the longitudinal axis of the elongated main portion 38.

Transversely extending in axial spaced apart relationship about the outer end 42 of the second swing arm 34 is a pair of cross members 44 and 46, the cross members being fixed to the outer end 42 by weldment or other suitable means. Secured to the cross members 44 and 46 is the mechanic's tray, indicated generally at 48.

The mechanic's tray 48 includes a generally flat bottom 50 secured to an upper side of each of the cross members 44 and 46, and including a series of sides secured around the border thereof, each side being referred to by the numeral 52.

Figure 3:
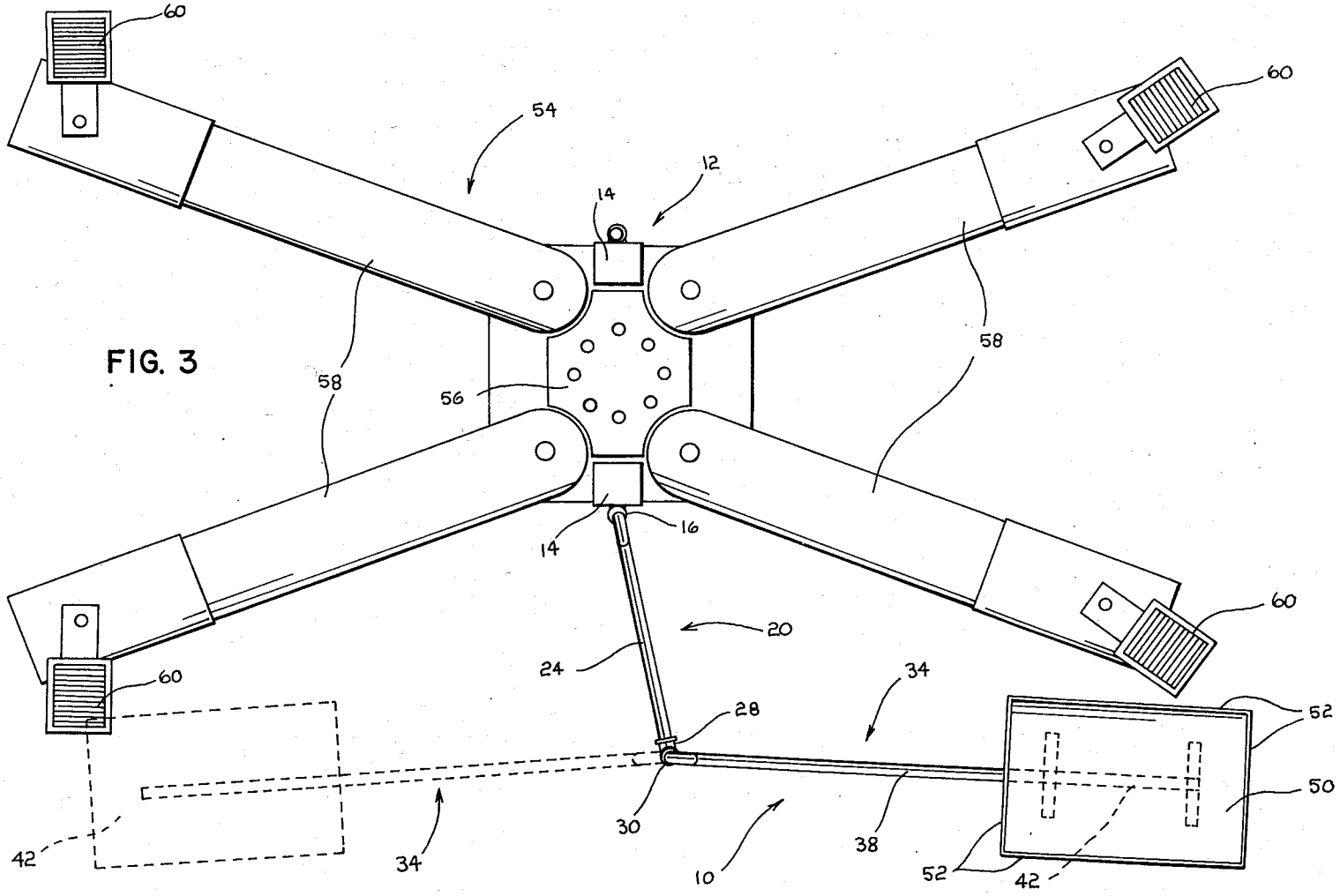
FIG. 3 is a top plan view of a vehicle service rack having the mechanic's tray assembly of the present invention installed thereon, the mechanic's tray being illustrated in front and rear positions with respect to the vehicle service rack.
Figure 4:
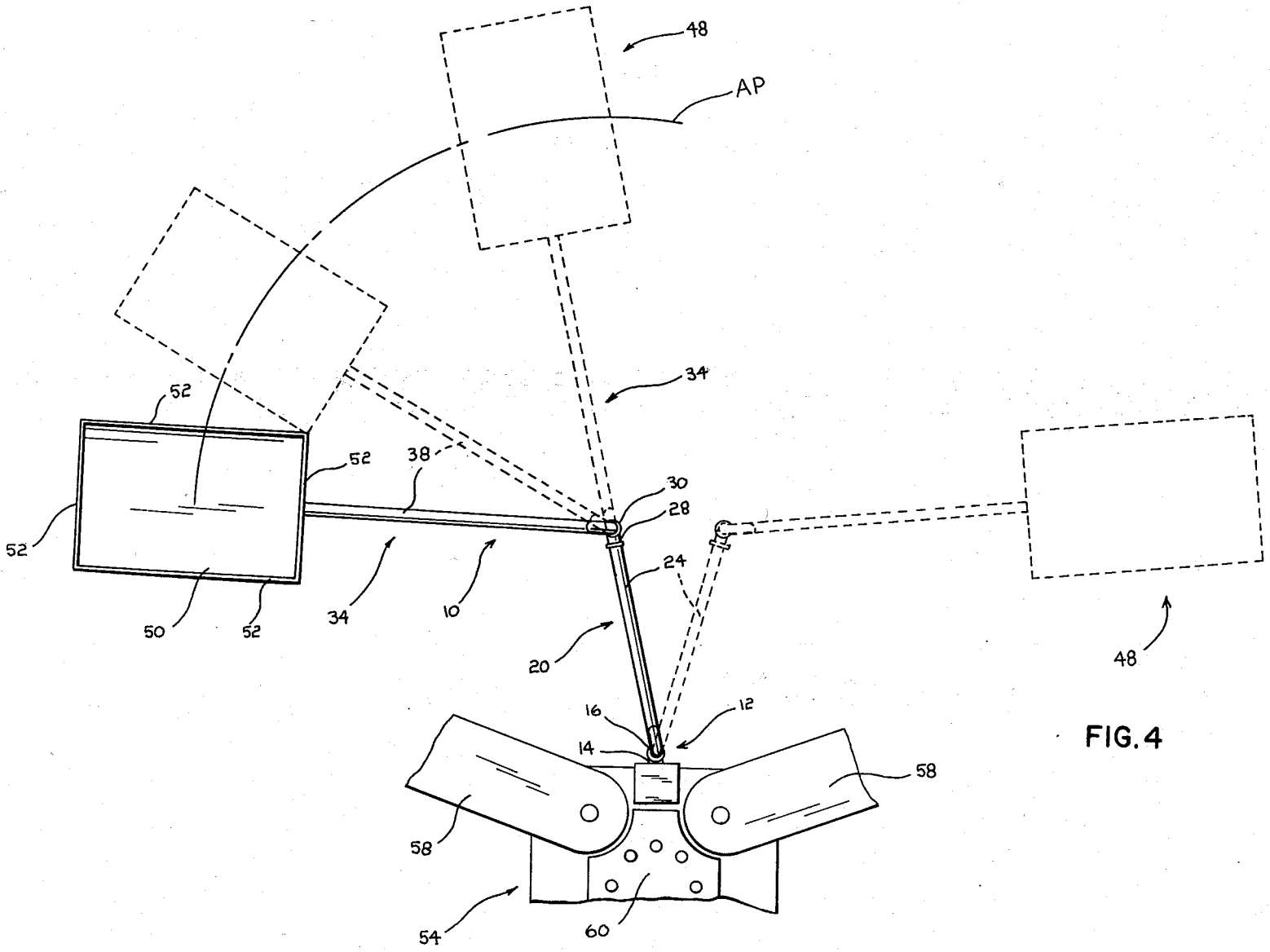
FIG. 4 is a fragmentary top plan view of a portion of the vehicle service rack illustrating again the installment of the mechanic's tray assembly thereof, the tray being shown disposed in a plurality of positions about one side of the vehicle service rack.

The mechanic's tray 10 just described is particularly adapted to be utilized in conjunction with a conventional vehicle service rack of the general type shown in FIGS. 3 and 4 and indicated generally by the numeral 54. Viewing the vehicle service rack 54, it is seen that the same includes a central support 56 stationed atop elevating means (not shown) that is typically hydraulically powered and adapted to raise and lower the support 56 relative to a floor. Fixed to and extending outwardly from the central support 56 is a series of particularly spaced frame supports, each frame support being indicated by the numeral 58 and including an adjustable foot 60 adapted in operation to engage and support the frame of a vehicle disposed thereover.

Figure 6:
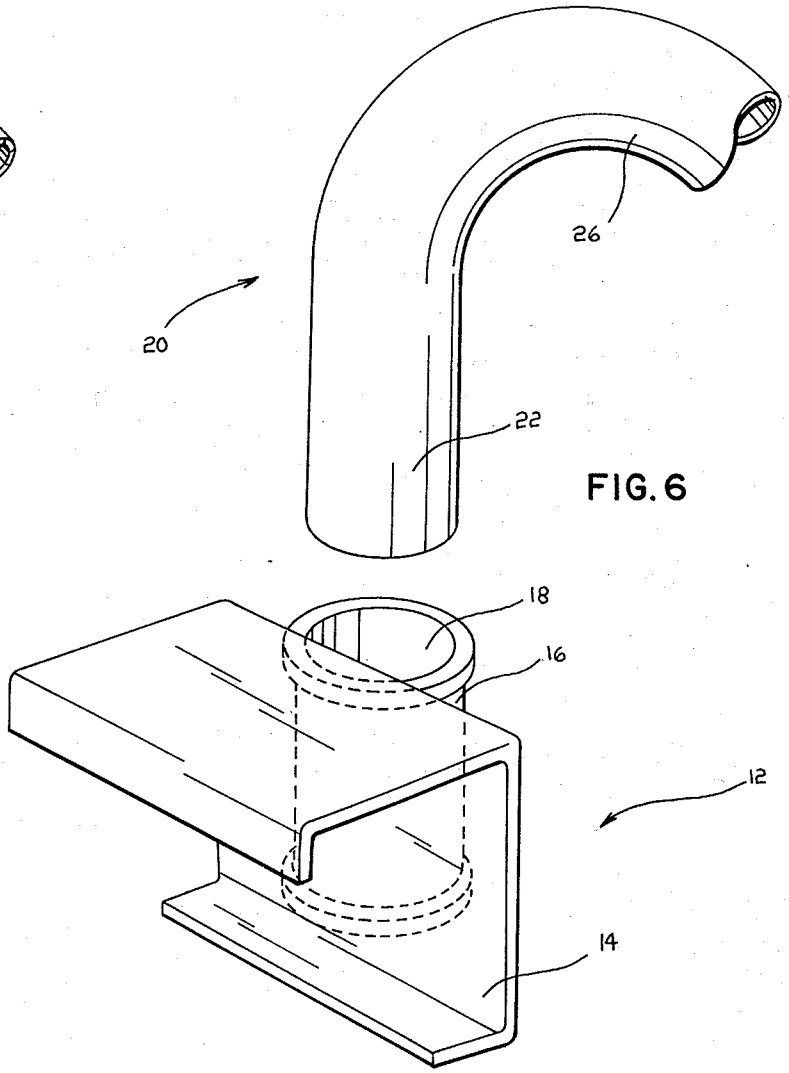
FIG. 6 is a fragmentary perspective view of the pivot end of the first swing arm and the main pivoting structure for receiving this pivot end and for supporting the entire cantilever extension structure of the mechanic's tray.
Figure 5:
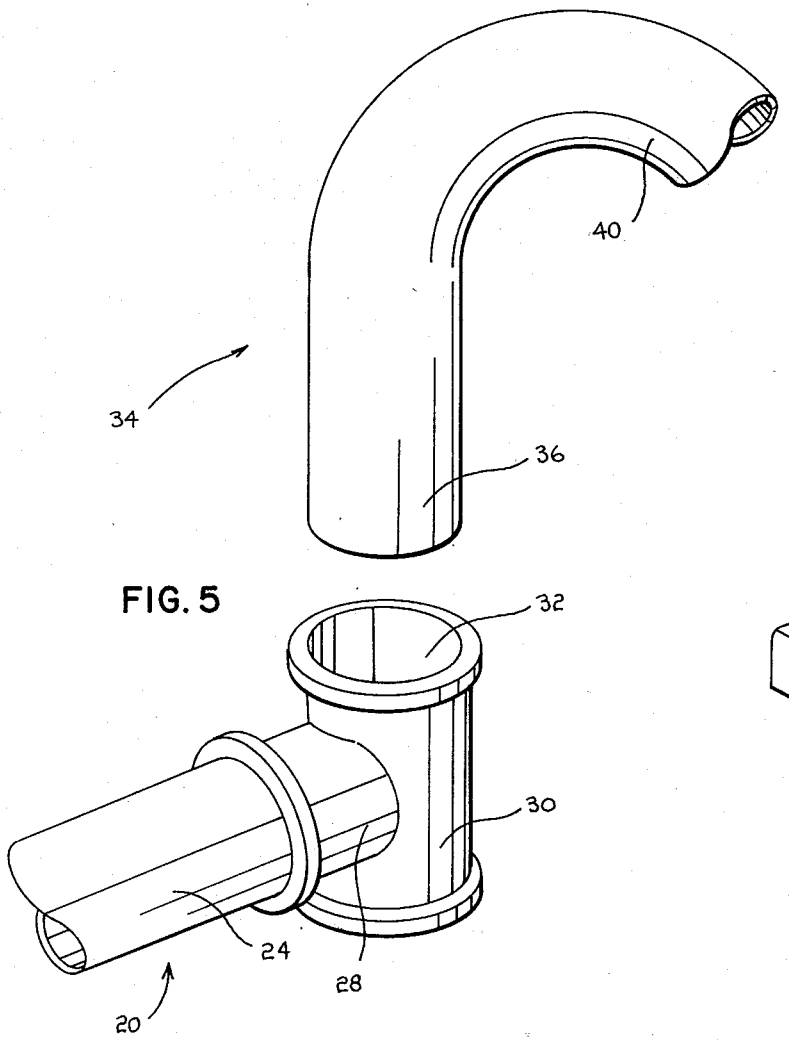
FIG. 5 is a fragmentary perspective view illustrating the pivot end of the second swing arm and the pivot connection therefor fixed to the outer end of the first swing arm.

In the present disclosure, the central or main pivot structure 12, as shown in FIG. 6, is preferably secured to the central support 56 on both longitudinal sides of the rack structure 54, as illustrated in FIG. 3. However, it should be appreciated that the particular placement of the central or main pivot structure 12 could vary depending on the design of the particular vehicle service rack in which the device of the present invention is intended to be used. In the case, as illustrated in FIG. 3, the central or main pivot structure 12 can be fixed to both sides of the rack structure 54 and the mechanic's tray assembly 10 can be interchanged between both sides by simply disconnecting the second swing arm 34 from the first swing arm 20, and changing the first swing arm 20 from one side of the rack 54 to the other side. It is seen that the pivot ends 22 and 36 are simply inserted into the openings within the respective collars, and the two swing arms 20 and 34 when pivotably interconnected form an elongated cantilever beam or frame structure for supporting the mechanic's tray 48.

As illustrated in FIG. 4, the tray 48 may be positioned in an infinite number of positions about the particular side of the rack in which the tray assembly 10 is mounted. When the first and second swing arms 20 and 34 are aligned, it is appreciated that the tray 48 may be swung in an arcuate path AP (as illustrated in FIG. 4) about the particular side of the rack. This arcuate path defines the maximum extension of the mechanic's tray assembly. By positioning and adjusting the second swing arm 34 with respect to the first swing arm 20, the mechanic's tray assembly can be positioned in various locations interiorly of the defined arcuate path AP on the particular side of the rack 54 where the tray assembly 10 is mounted.

Therefore, from the foregoing specification, it is seen that the mechanic's tray assembly of the present invention is particularly adapted to be utilized in conjunction with a vehicle service rack of the conventional hydraulically actuated type found in service stations and garages. By providing a series of pivotably interconnected swing arms for supporting the mechanic's tray, it is seen that the mechanic or serviceman can manually position the tray in an infinite number of positions underneath the rack and vehicle on either side. It also follows from the foregoing specification that because of the detachable and breakdown feature of the first and second swingable arms 20 and 34, that the mechanic's tray assembly of the present invention can be utilized in various locations within a garage or shop and can easily and conveniently be maintained and repaired if necessary.

The terms "upper", "lower", "forward", "rearward", etc., have been used herein merely for the convenience of the foregoing specification and in the appended claims to describe the mechanic's tray assembly and its parts as oriented in the drawings. It is to be understood, however, that these terms are in no way limiting to the invention since the mechanic's tray assembly may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. In a vehicle service rack structure including a rack for supporting a vehicle and means for raising and lowering said rack, the improvement comprising a horizontal swinging mechanic's tray assembly positionable at any number of locations about the rack and adapted to support parts, hardware, wrenches and other paraphernalia for the convenience of a serviceman or mechanic while working on a particular vehicle supported by the rack, said mechanic's tray assembly comprising: a main pivot support means fixedly mounted to one side of said rack structure about a generally central portion thereof at a point below the horizontal plane of the rack for supporting said swingable mechanic's tray such that the mechanic's tray assembly may be horizontally moved from the front portions of the rack to the back portions thereof at a level below the rack, said main pivot support means including a collar having a vertical opening formed therein; a first swing arm pivotably mounted to said main pivot support means and extending therefrom in cantilever fashion, said first swing arm including an elongated main portion having an outer end and an inner pivot end adapted to be pivotably mounted within the collar of said main pivot support means; an intermediate pivot support means fixed to the outer end of said first swing arm and including a collar having a vertical opening therein; a second swing arm pivotably mounted to said intermediate pivot support means and including an elongated main portion having an outer end and an inner pivot end adapted to be rotatively journaled within the opening within the collar of said intermediate pivot support means whereby said second swing arm may pivot independently of said first swing arm and wherein the pivot ends of both said first and second swing arms are integrally constructed with the elongated main portions of each swing arm, and wherein each pivot end is turned such that the axis thereof extends generally perpendicular to the axis of the main elongated portion of the respective swing arm whereby each of said swing arms may be pivotably supported by inserting the respective turned ends into the respective collars of said main and intermediate pivot support means, and wherein each swing arm includes an intermediate raised arcuate shaped neck extending immediately between each pivot end and the elongated main portion thereof, thereby tending to reduce possible sliding friction between the respective pivot collars and portions of each swing arm disposed outwardly and adjacent said collars when the swing arms are pivotably mounted therein; support means fixed to the outer end of said second swing arm; and a tray fixed to said support means on the outer end of said second swing arm for receiving and supporting various paraphernalia used by a mechanic or serviceman while working on a particular vehicle supported by said rack, said tray including a generally flat rectangular shaped bottom and a plurality of sides extending generally upwardly around said flat bottom to form an open top receiving tray.

2. The improved device of claim 1 wherein said support means includes a pair of inverted L-shaped cross members extending perpendicular relative to the longitudinal axis of the main elongated portion of said second swing arm and fixed to said second swing arm in axial spaced apart relationship relative thereto such that the upper side of said L-shaped cross members are horizontally disposed for receiving the bottom of said tray.

* * * * *